US007883235B2

(12) United States Patent
Galli

(10) Patent No.: US 7,883,235 B2
(45) Date of Patent: Feb. 8, 2011

(54) HERMETICALLY SEALED FLASHLIGHT ASSEMBLY

(76) Inventor: Robert D. Galli, 135 Circuit Dr., North Kingstown, RI (US) 02852

( * ) Notice: Subject to any disclaimer, the term of this patent is extended or adjusted under 35 U.S.C. 154(b) by 0 days.

(21) Appl. No.: 11/856,432

(22) Filed: Sep. 17, 2007

(65) Prior Publication Data

US 2008/0002397 A1 Jan. 3, 2008

Related U.S. Application Data

(63) Continuation of application No. 11/067,187, filed on Feb. 26, 2005, now Pat. No. 7,287,873.

(60) Provisional application No. 60/557,234, filed on Mar. 29, 2004.

(51) Int. Cl.
*F21L 4/00* (2006.01)

(52) U.S. Cl. ..... 362/208; 362/158; 362/200; 24/312; 24/311; 24/625

(58) Field of Classification Search ..... 362/200, 362/202, 208, 158, 512, 101; 313/512; 257/98, 257/100; 24/3.4, 3.11, 3.12, 625, 578.1
See application file for complete search history.

(56) References Cited

U.S. PATENT DOCUMENTS 3,809,882 A 5/1974 Wetmore
4,152,755 A * 5/1979 Trosper et al. ..... 362/158
5,036,248 A 7/1991 McEwan et al.
5,313,376 A * 5/1994 McIntosh ..... 362/119
5,573,109 A * 11/1996 Isacson ..... 206/38.1
5,622,422 A * 4/1997 Rodgers ..... 362/158
5,869,934 A 2/1999 Goff
6,135,611 A * 10/2000 Maglica ..... 362/158
6,145,172 A * 11/2000 Bourdon ..... 24/625
6,591,646 B1 * 7/2003 Huang ..... 70/456 R
6,711,785 B1 * 3/2004 Hicks et al. ..... 24/3.4
6,808,290 B2 10/2004 Lee
2002/0021573 A1 2/2002 Zhang
2002/0114154 A1 8/2002 Galli
2003/0033697 A1 * 2/2003 Hicks et al. ..... 24/615
2005/0213318 A1 9/2005 Galli
2006/0018098 A1 1/2006 Hill et al.

* cited by examiner

*Primary Examiner*—Jong-Suk (James) Lee
*Assistant Examiner*—Robert J May
(74) *Attorney, Agent, or Firm*—Barlow, Josephs & Holmes, Ltd.

(57) ABSTRACT

A lighting assembly that incorporates a high brightness LED in a compact assembly that is sealed and sufficiently durable for a continuous operational range of between 350 feet below sea level and 35,000 feet above sea level. Further, the flashlight of the present invention includes a novel modular interface arrangement that allows the flashlight to be interfaced with a variety of different equipment or reconfigured in order to facilitate use for different functionality such as a marker light, a runway indicator light or a weapon mounted light.

10 Claims, 11 Drawing Sheets

HERMETICALLY SEALED FLASHLIGHT ASSEMBLY

CROSS-REFERENCE TO RELATED APPLICATIONS

This application is related to and claims priority from earlier filed U.S. Utility application Ser. No. 11/067,187, filed Feb. 26, 2005, which claims priority from U.S. Provisional Patent Application No. 60/557,234, filed Mar. 29, 2004.

BACKGROUND OF THE INVENTION

The present invention relates generally to a sealed flashlight assembly. More specifically, the present invention relates to a new portable flashlight assembly and more particularly to compact flashlight assembly that is highly durable and completely sealed against the effects of environmental pressure changes while also being constructed for easy mounting and integration into a variety of applications.

Typically, in prior art flashlights manufactured for use underwater, one of the major problems is making the assembly watertight. Waterproofing the operable components of the switch tends to be particularly troublesome. Often rubber diaphragms and covers have been used as outer seals and the switch must be operated through the seal. After prolonged use, these seals wear and are prone to leakage. Other parts, such as removable ends for replacement of battery and bulb, also must be sealed and servicing the unit often results in damage to or destruction of the seals. Further, if these flashlights are configured for use in deep water at depths approaching 350 feet below sea level, they typically require a pressure-equalizing valve to prevent them from imploding from the force of the surrounding environmental pressures. This problem is further complicated when the same light is also required to operate at high altitudes such as at 35,000 feet above sea level. Again, a pressure-equalizing device must be incorporated to prevent the light from exploding from a build up of internal pressures. Generally, the pressure-equalizing device used for underwater applications will fail at high altitudes and the high altitude device will fail in deep water.

These pressure equalization issues are exacerbated by the fact that the portable flashlights in the prior art typically include a cylindrical housing that encloses the light source, power source, required circuitry, the operable switch element and a relatively large volume of air. It is this volume of air that has the greatest effect on the ability of the flashlight to transition from high altitude operation to deep-sea operation. Further, the slide type switch or a spring loaded button type switch of these prior art flashlights require that a portion of the operable components reside on the exterior of the light while another portion is positioned on the interior resulting in a weak point at the interface between these operable elements.

Accordingly, there is a need for a flashlight that substantially eliminates the operational disadvantages of prior art flashlights. There is also a need for a flashlight that has a hermetically sealed interior that eliminates substantially all of the air from the interior of the flashlight while also preventing the entry of moisture thereinto. There is a further need for a flashlight that can be actuated using interior and exterior components that do not require a physical interface thereby eliminating a weak point in the housing. There is yet a further need for a sealed flashlight that can serve a variety of different functional needs and provide an ability to interface with a broad range of other equipment.

BRIEF SUMMARY OF THE INVENTION

In this regard, the present invention provides for a novel lighting assembly that incorporates a high brightness LED in a compact assembly that is sealed and sufficiently durable for a continuous operational range of between 350 feet below sea level and 35,000 feet above sea level. The light includes at least one high brightness light emitting diode to provide high intensity light. The output range may be in any visible light color. Preferably, the output will be in the visible white range either by using an Indium Gallium Nitride/Gallium Nitride chip with a phosphor coating such as a Nichea white LED. Similarly, as would be obvious in the art other white LED's could easily be substituted for the same effect. For example, an Aluminum Indium Gallium Arsenide LED could easily be substituted. Further, any other white light source such as incandescent, halogen or xenon could also be used.

The flashlight may also include auxiliary lighting functions in combination with or in place of the white light element. The present invention may also include a red light diode for night vision operations, an infrared diode for use in conjunction with night vision goggles or a laser diode for automated firing or targeting systems. Any of these features may be included either alone or in combination in the flashlight of the present invention.

Further, the flashlight of the present invention includes a novel modular interface arrangement that allows the flashlight to be interfaced with a variety of different equipment or reconfigured in order to facilitate use for different functionality such as a marker light, a runway indicator light or a weapon mounted light.

It is therefore an object of the present invention to provide a flashlight that has an operational range that exceeds the operational limits encountered with prior art flashlights. It is a further object of the present invention to provide a flashlight that has a hermetically sealed interior and which eliminates substantially all of the air from the interior of the flashlight while also preventing the entry of moisture thereinto. It is yet a further object of the present invention to provide a flashlight that can be actuated using interior and exterior components that do not require a physical interface thereby eliminating a weak point in the housing. It is still a further object of the present invention to provide a sealed flashlight that can serve a variety of different functional needs and provide an ability to interface the flashlight with a broad range of other equipment and accessories.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
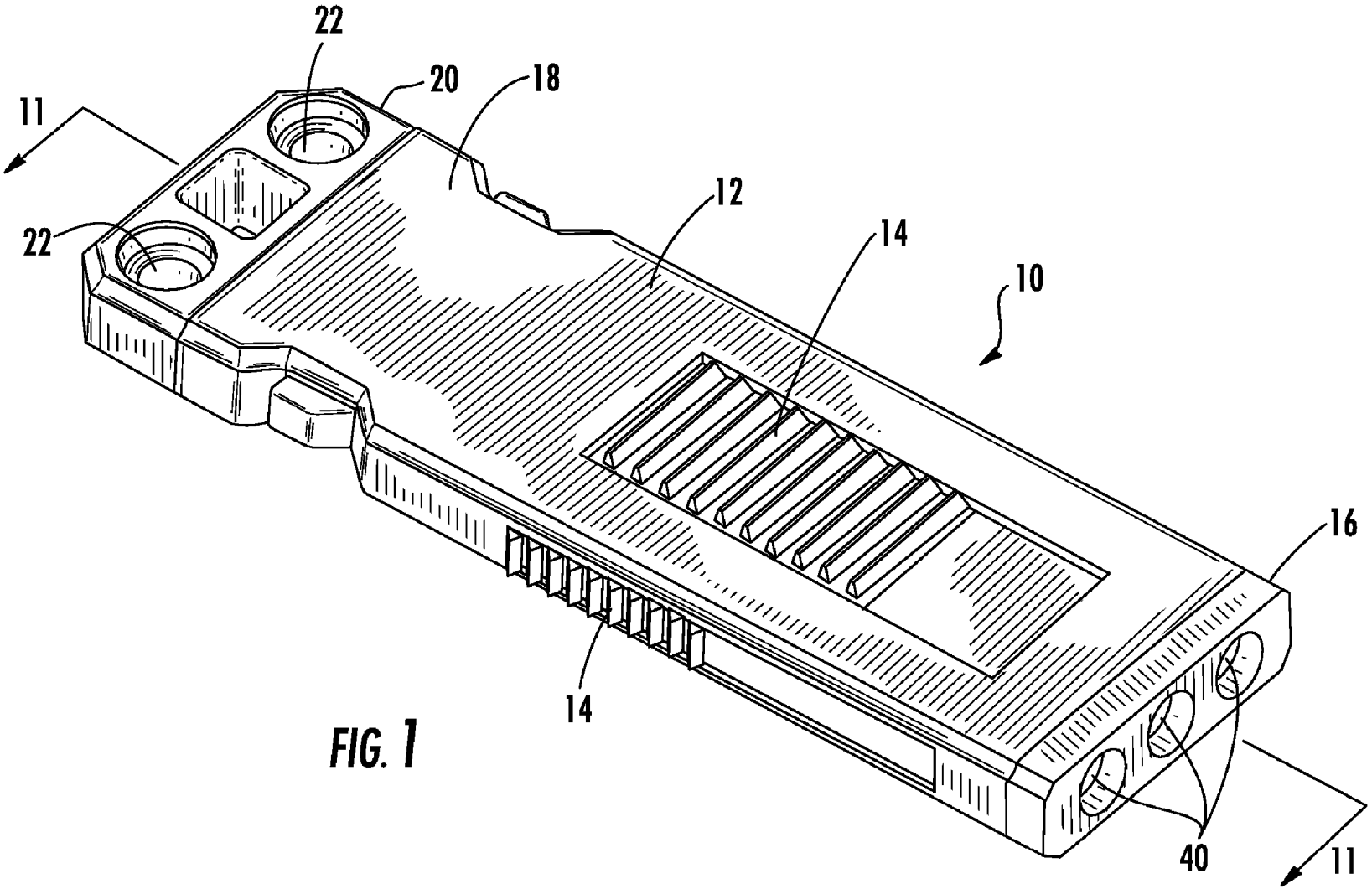
FIG. 1 is a front perspective view of the flashlight of the present invention.

Now referring to the drawings, the lighting assembly of the present invention is shown and generally illustrated in the figures as 10. The lighting assembly 10 is the central component for the modular system described herein. The lighting assembly 10 can be seen to include an outer housing 12, at least one slide switch 14, a head assembly 16 and a modular interface 18 for receiving various modular accessories including the modular accessory mount 20 shown.

Figure 2:
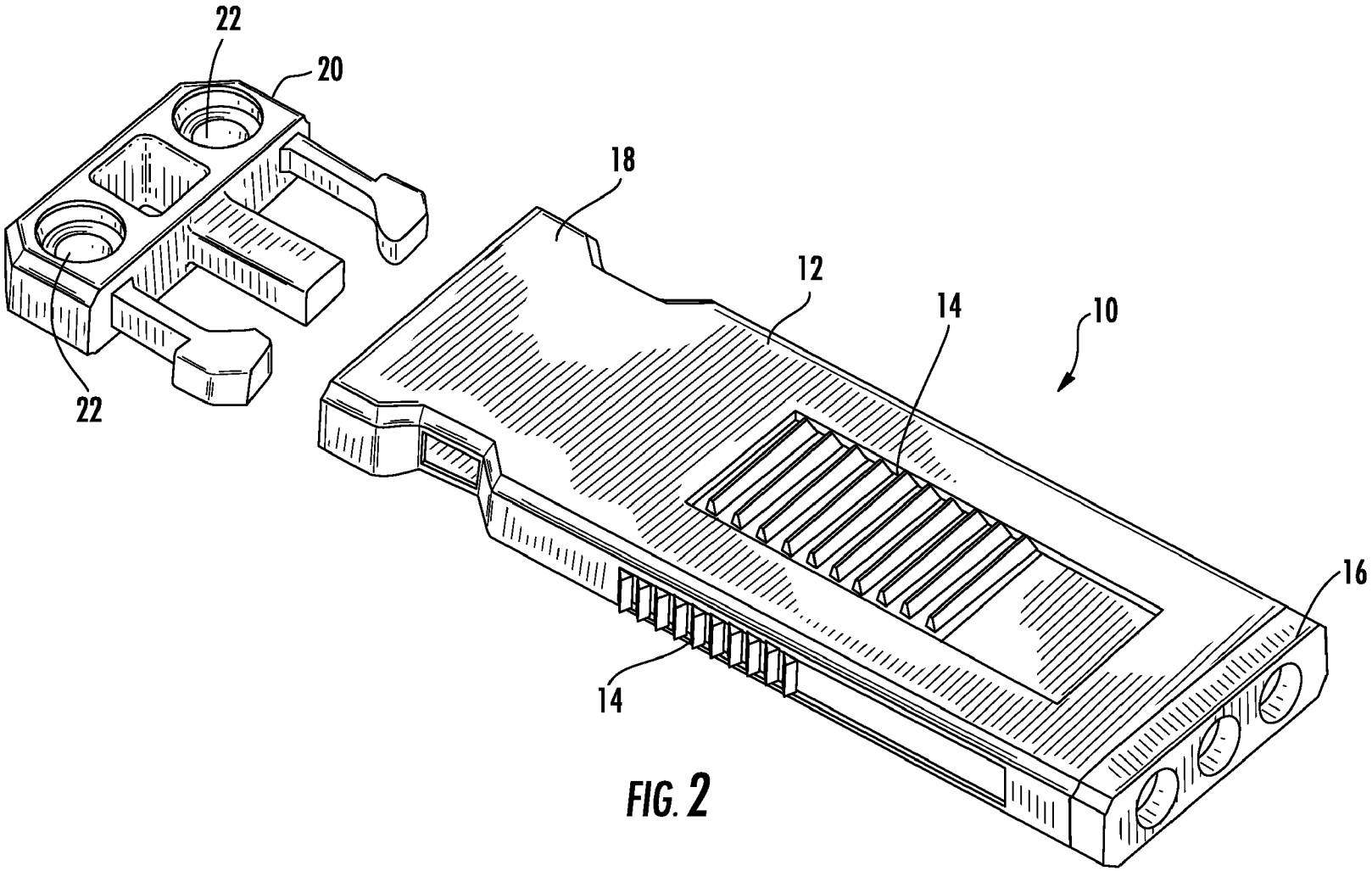
FIG. 2 is a front view of the flashlight of the present invention with the modular accessory mount removed.

The outer housing 12 of the lighting assembly 10 of the present invention is configured in a novel manner to allow its integration into various systems and configurations. The outer housing 12 is formed to include a modular interface 18 that serves as one end of a detachable clip element. As can best be seen in FIG. 2, the modular interface 18 is shown as being formed as a female receptor end of a detachable clip assembly. Similarly, although not shown, the modular interface 18 provided on the housing 12 of the lighting assembly 10 may be formed as a male end. This allows the corresponding male or female portion to be formed on a variety of other devices such as a modular accessory mount 20. By providing a modular interface 18, the lighting assembly 10 can easily be mounted and de-mounted allowing modular accessories to be interfaced with the lighting assembly 10 as desired.

Figure 3:
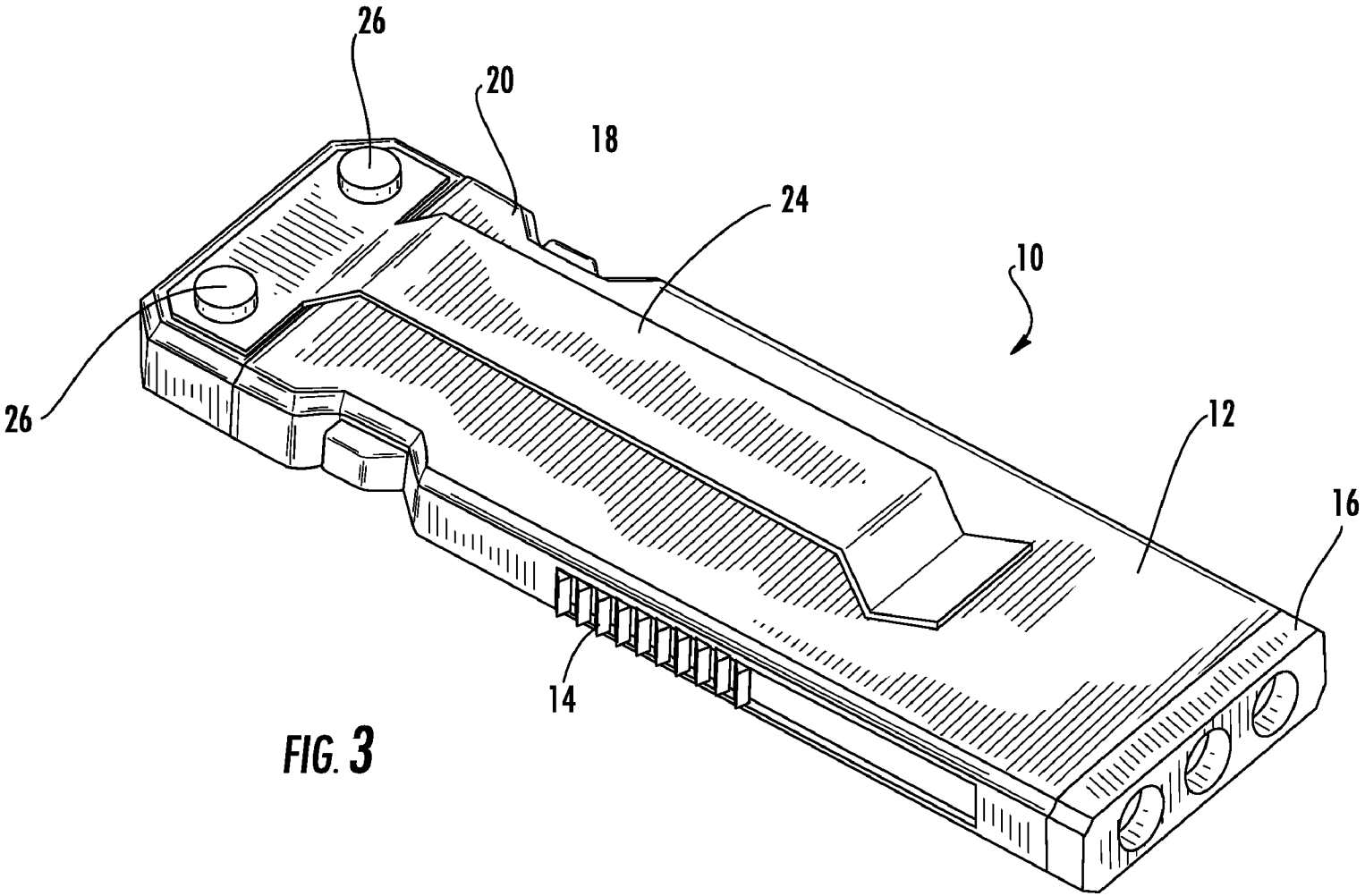
FIG. 3 is a bottom perspective view of the flashlight of the present invention with a modular clip installed in place of the modular accessory mount.
Figure 4:
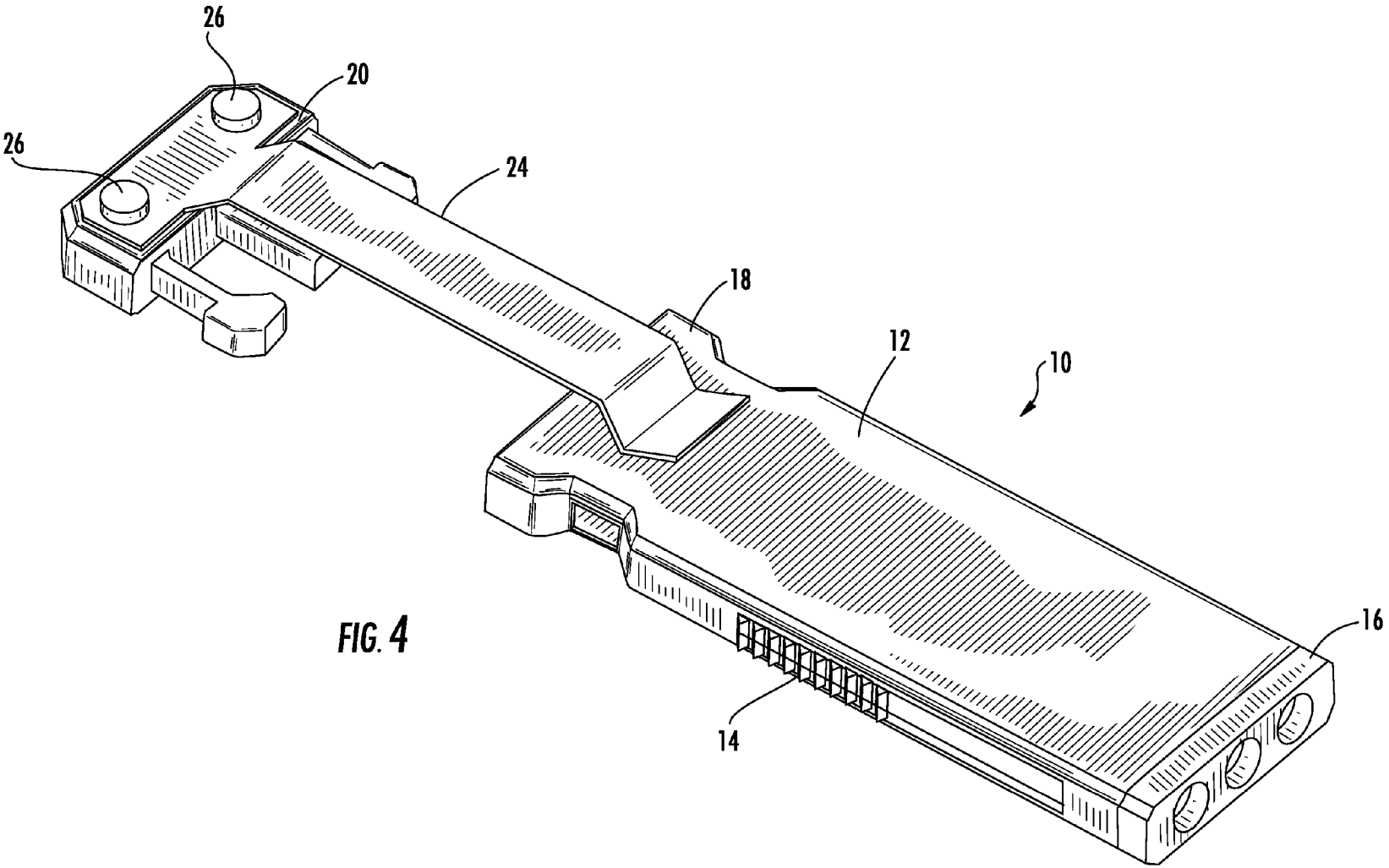
FIG. 4 is a bottom perspective view of the flashlight of the present invention with the modular clip removed.
Figure 5:
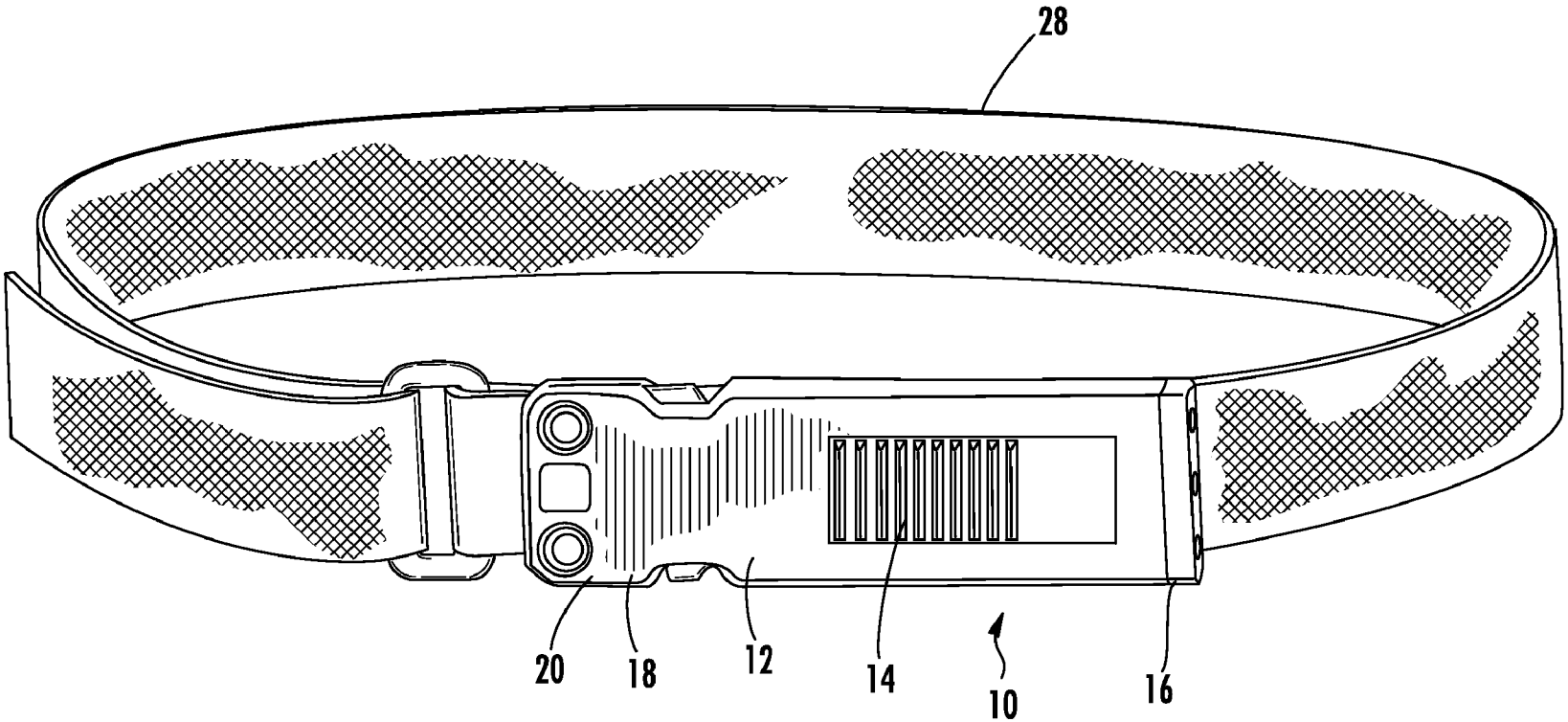
FIG. 5 is a perspective view of the flashlight of the present invention received on a belt using the modular interface.
Figure 6:
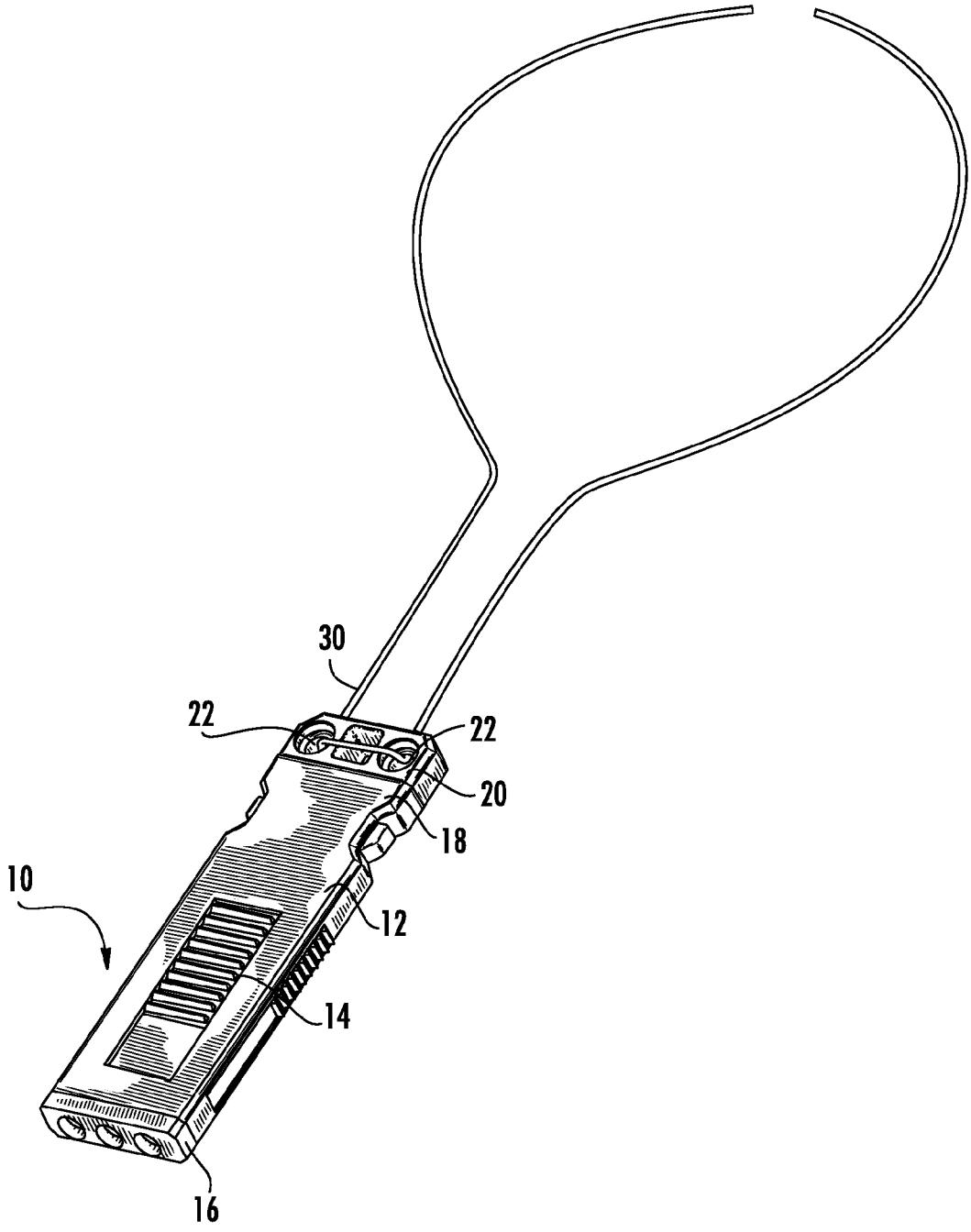
FIG. 6 is a perspective view of the flashlight of the present invention with a lanyard attached to the modular accessory mount.
Figure 7:
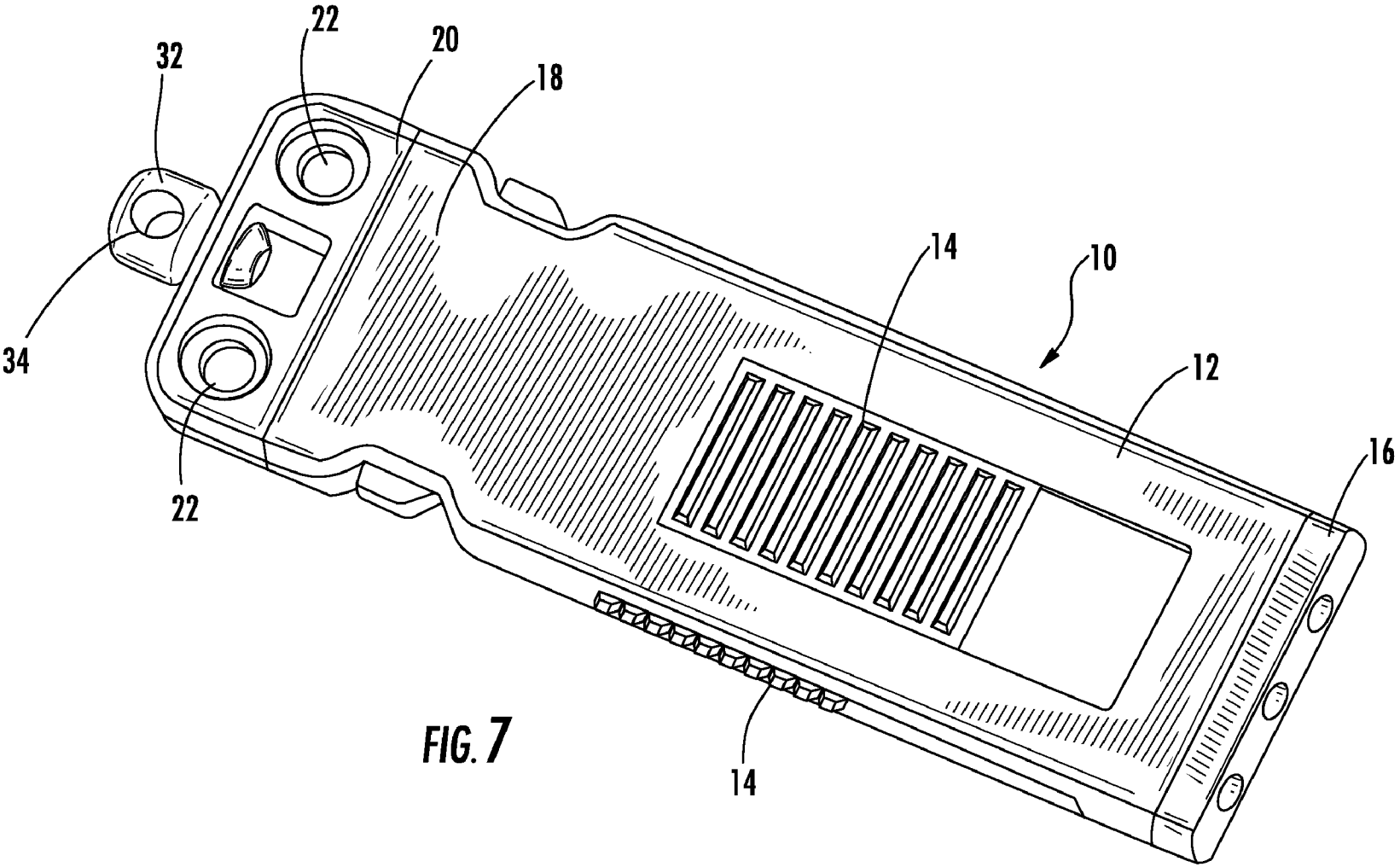
FIG. 7 is a perspective view showing a gimbal installed on the modular accessory mount.
Figure 8:
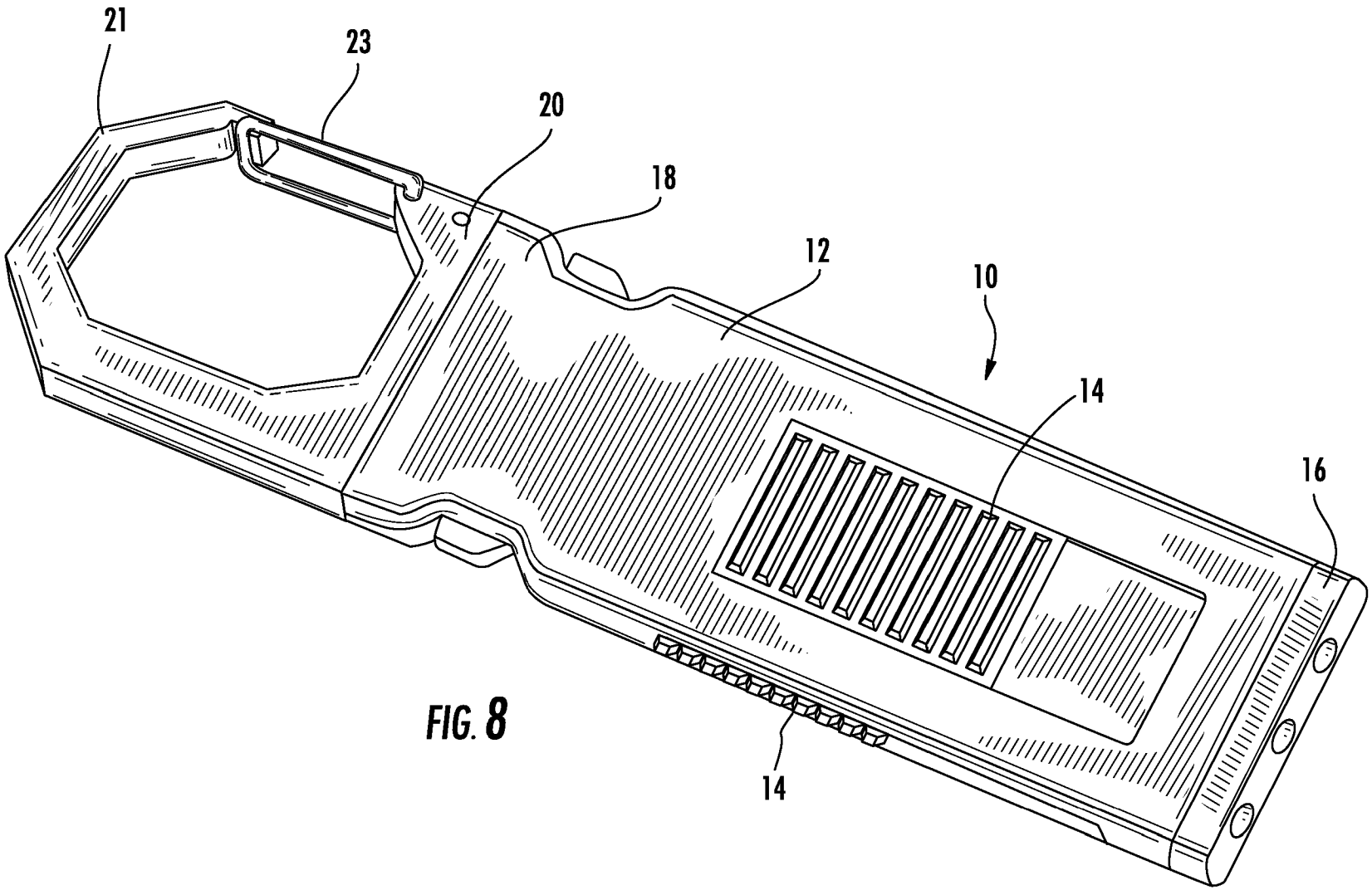
FIG. 8 is a perspective view showing a clip received in place of the modular accessory mount.

The modular accessory mount 20 in its simplest form may be a clip with holes 22 provided therein to facilitate attachment of other accessories. FIGS. 3 and 4 illustrate a clip accessory 24 that is attached to the modular accessory mount 20 by installing fasteners 26 into the holes 22. Optionally, accessories may be joined with the accessory mount 22 by riveting, heat staking or direct molding. Similarly, FIG. 5 illustrates the modular accessory mount 20 attached to a belt or strap 28 with the lighting assembly 10 engaged onto the accessory mount 20. In this manner, the strap 28 can be worn as a belt, an armband or a headband allowing the lighting assembly 10 to be worn on in a convenient location by the user. FIG. 6 illustrates a lanyard loop 30 that is passed through the holes 22 in the accessory mount 20 allowing the lighting assembly 10 to be worn around the user's neck or tied in a desired hanging location. FIG. 7 further illustrates a swivel or gimbal 32 that is mounted into the rear of the accessory mount 20. The swivel 32 is also capable of receiving a lanyard loop 30 in the hole 34 provided therein if desired. FIG. 8 alternately shows that the accessory mount 20 may be formed into different configurations such as a key ring extension 21 with a spring type lock 23.

Figure 9:
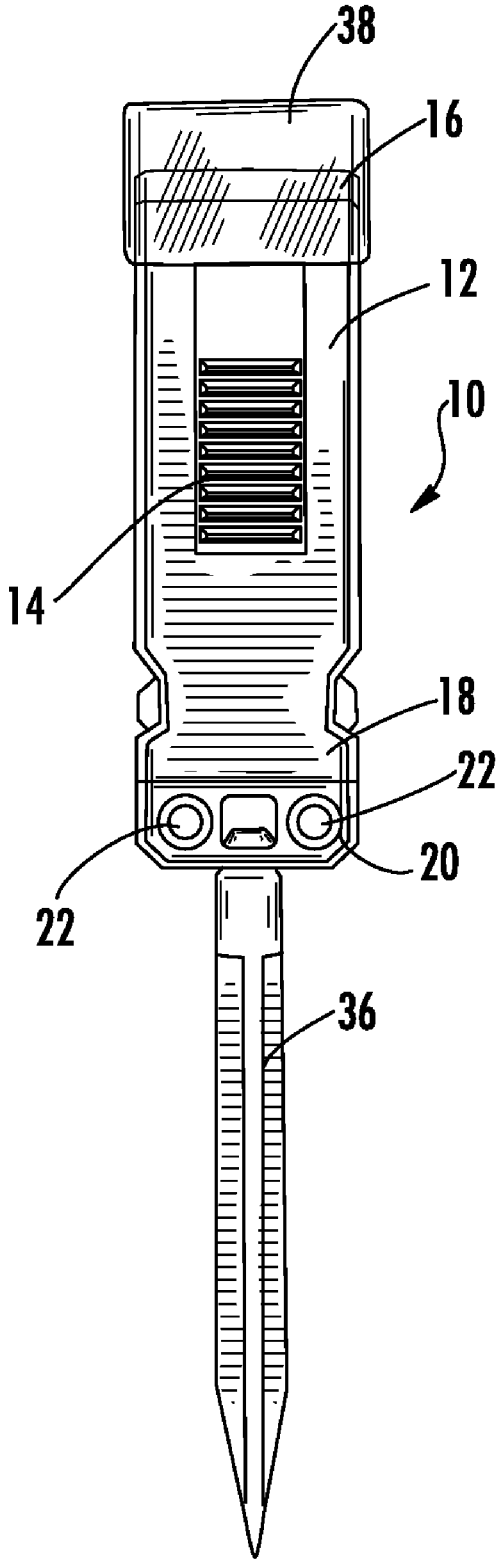
FIG. 9 is a front view showing a stake installed on the modular accessory mount and a diffuser installed over the output end of the flashlight.
Figure 10:
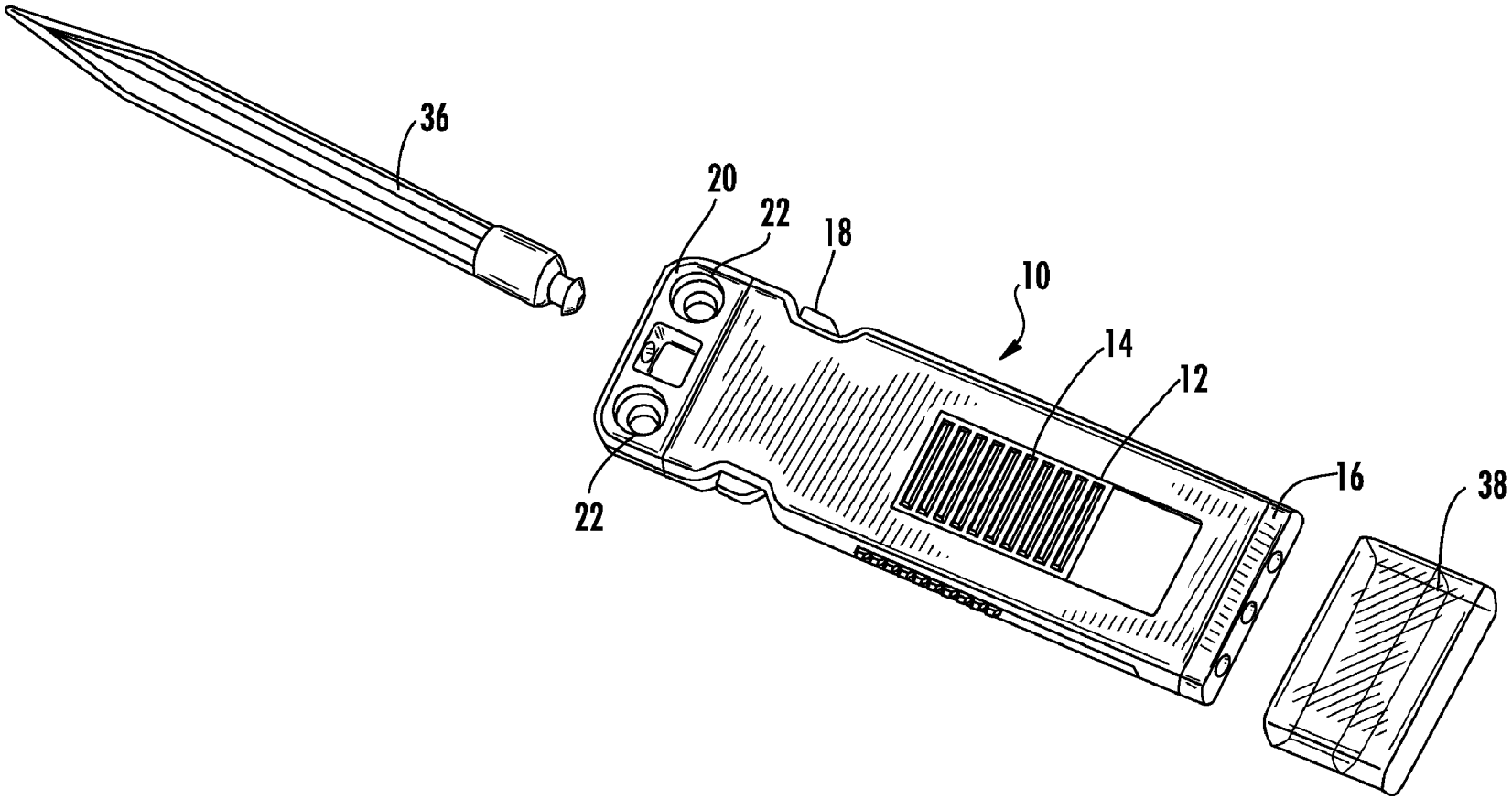
FIG. 10 is an exploded perspective view showing the flashlight, stake and diffuser.

Turning now to FIGS. 9 and 10, to further tailor the lighting assembly 10 to the desired military applications, the accessory mount 20 is shown coupled to a stake 36 to allow the lighting assembly 10 to be staked into a desired location on the ground. The stake 36 allows the lighting assembly 10 to be positioned in a manner that allows it to serve as a locator beacon or a runway marker. To enhance the operation as a runway marker, a diffuser element 38 is shown installed over the output end of the lighting assembly 10.

Figure 11:
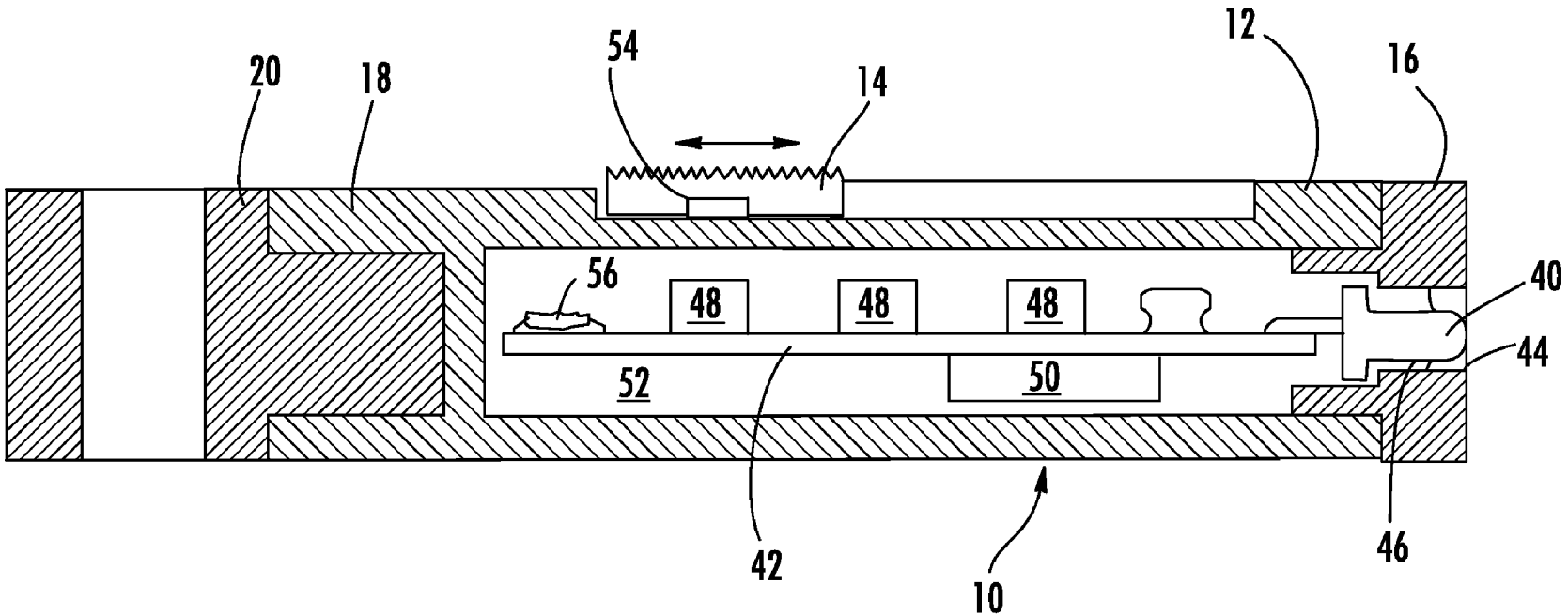
FIG. 11 is a cross-sectional view taken along line 11-11 of FIG. 1.

Turning to FIG. 11, the internal components and the operation of the lighting assembly 10 is illustrated. The lighting elements 40 are mounted to a circuit board 42 and extend through openings 44 in a head assembly 16. As was stated above, the preferred lighting element 40 is a high intensity white LED, although any diode element available on the market including an LED in the visible range, an infrared diode, an ultraviolet diode or a laser diode may also be incorporated into the lighting assembly 10 and still fall within the scope of the present invention. The joint around the LED 40 optical portion is sealed using a potting compound 46, silicon or epoxy material. Also contained on the circuit board 42 are magnetic sensor elements 48 such as Hall effect sensors or mechanical reed switches, operational circuitry and a power source 50 such as a high capacity coin cell battery. The circuit board 42 and head 16 are placed into a housing enclosure 12. The void 52 within the enclosure 12 is then injected with a potting compound such as an epoxy or a silicone material to seal the entire assembly and evacuate any air within the housing 12. To further enhance the sealing process and evacuate any air, the lighting assembly 10 may be placed in a vacuum environment before injecting the sealant material.

Operation of the lighting device 10 is accomplished using slide switches 14 placed on the exterior of the housing 12. The slides 14 have magnets 54 therein that are positioned above the magnetic sensors 48. Depending on the specific position of the magnet 54 relative to a particular sensor 48, the circuitry on the circuit board 42 will operate the lighting assembly 10 in a particular manner. For example, one switch 14 may determine which lighting function will operate while another slide 14 may regulate intensity and a third slide 14 would control function such as constant on or strobe.

Each switch slide 14 may use any number of sensors 48 and/or magnets 54 from at least one to any greater number, depending on the number of functions desired to be controlled by the switch assembly 14. The sensors 48 are all electrically connected to a computer logic chip 56 via circuit traces on the surface of the circuit board 42. When a magnet 54 is placed directly above one of the sensor positions 48 the sensor 48 detects a magnetic field generated by the magnet 54 and creates an "ON" condition that is sensed by the computer chip 56. In the same manner an array of magnets 54 may be provided in the slide actuator 14 that can be selectively positioned over the array of sensors 48 to create numerous combinations of "ON" and "OFF" codes.

In this manner it can be seen that the present invention provides a completely sealed lighting assembly 10 is provided with a greater operational range than was previously known in the art, while also providing a modular interface that promotes integration of the lighting assembly 10 into a variety of configurations. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular flashlight system comprising:

a flashlight fully contained and operational within an outer housing, said outer housing including a female receptor end of a detachable clip element integrally formed within one end thereof, said female receptor end including at least one set of interfitting mating formations;

a modular accessory mount having a corresponding male clip element that includes complementary interfitting mating formations that are configured to be received and retained by said interfitting mating formations in said female receptor end at a first end thereof and a second end including apertures therein that receive and retain an accessory device, wherein said modular accessory mount is selectively removable from said flashlight while said flashlight remains operational.

2. The modular flashlight system of claim 1, wherein said accessory device is selected from the group consisting of: a lanyard, a lanyard swivel, a strap, a belt clip, a keyring extension and a stake.

3. The modular flashlight system of claim 1, wherein said flashlight is a multi-functional flashlight that can be activated in several different modes of operation.

4. The modular flashlight system of claim 1, wherein said flashlight further comprises:

said outer housing having a cavity disposed therein and an opening at one end opposite said modular interface;

a head assembly received into said opening in said outer housing, said head assembly having at least one aperture therein;

a circuit board within said cavity in said outer housing;

a light source mounted on said circuit board, a portion of said light source extending into said aperture in said head assembly; and a sealant disposed around said circuit board and substantially filling said entire cavity.

5. The modular flashlight system of claim 4, further comprising:

said circuit board further having at least one magnetically sensitive contact and a power source mounted thereon; and a magnetic actuator received on the exterior of said outer housing, said actuator slidable between a first position and a second position, wherein said actuator in said first position creates a magnetic field adjacent said magnetically sensitive contact causing said light source to illuminate.

6. A modular flashlight system comprising:

a flashlight fully contained and operational within an outer housing, said outer housing including a male end of a detachable clip element integrally formed within one end thereof said male end including at least one set of interfitting mating formations;

a modular accessory mount having a corresponding female receptor end that includes complementary interfitting mating formations that are is configured to be received and retained by said interfitting mating formations on said male end at a first end thereof and a second end including apertures therein that receive and retain an accessory device, wherein said modular accessory mount is selectively removable from said flashlight while said flashlight remains operational.

7. The modular flashlight system of claim 6, wherein said accessory device is selected from the group consisting of: a lanyard, a lanyard swivel, a strap, a belt clip, a keyring extension and a stake.

8. The modular flashlight system of claim 6, wherein said flashlight is a multi-functional flashlight that can be activated in several different modes of operation.

9. The modular flashlight system of claim 6, wherein said flashlight further comprises:

said outer housing having a cavity disposed therein and an opening at one end opposite said modular interface;

a head assembly received into said opening in said outer housing, said head assembly having at least one aperture therein;

a circuit board within said cavity in said outer housing;

a light source mounted on said circuit board, a portion of said light source extending into said aperture in said head assembly; and a sealant disposed around said circuit board and substantially filling said entire cavity.

10. The modular flashlight system of claim 9, further comprising:

said circuit board further having at least one magnetically sensitive contact and a power source mounted thereon; and a magnetic actuator received on the exterior of said outer housing, said actuator slidable between a first position and a second position, wherein said actuator in said first position creates a magnetic field adjacent said magnetically sensitive contact causing said light source to illuminate.

* * * * *